United States Patent [19]

Rudolf

[11] Patent Number: 4,620,172

[45] Date of Patent: Oct. 28, 1986

[54] ELECTROMAGNETIC RELAY WITH SWITCH SPRING

[75] Inventor: Reiner Rudolf, Fridingen, Fed. Rep. of Germany

[73] Assignee: Hengstler GmbH Geschaftsbereich Haller-Relais, Wehingen, Fed. Rep. of Germany

[21] Appl. No.: 624,255

[22] Filed: Jun. 25, 1984

[30] Foreign Application Priority Data

Jun. 28, 1983 [DE] Fed. Rep. of Germany ..... 3323266

[51] Int. Cl.[4] ..... H01H 51/22; H01H 51/08

[52] U.S. Cl. ..... 335/78; 335/81; 335/128

[58] Field of Search ..... 335/78, 79, 80, 83, 335/124, 128, 201, 81; 200/144 R; 403/349

[56] References Cited

U.S. PATENT DOCUMENTS

| | | | |
|---|---|---|---|
| 306,874 | 10/1884 | Thatcher | 403/349 |
| 402,132 | 4/1889 | Berry | 403/349 |
| 3,295,078 | 12/1966 | Hrynewycz | 335/281 |

*Primary Examiner*—Harold Broome

*Attorney, Agent, or Firm*—Paul H. Gallagher

[57] ABSTRACT

The electromagnetic relay is constructed as a monostable or as a bistable relay with a rotatable tumbler switch. In both forms, there is a switch spring, that is adapted to the anchor, resolvably fastened in the anchor. Thereby an improved mass moment of inertia results, as well as improved switch stop of the relay, and an improved shock and vibration resistance. The switch spring has a sprayed-on synthetic footpiece which is fastened resolvably, turnably and pushably in an adapted opening of the anchor.

5 Claims, 8 Drawing Figures

ELECTROMAGNETIC RELAY WITH SWITCH SPRING

Figure 1:
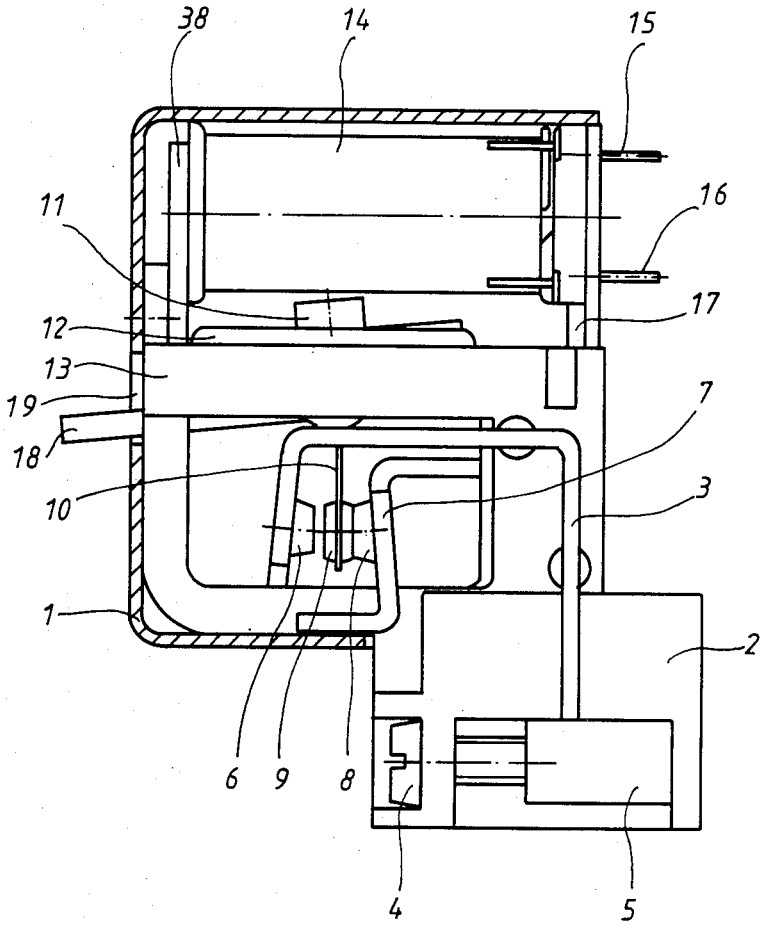

The invention concerns an electromagnetic relay, consisting of a driving system with exciter coil and yoke plates, which form, with a rotatable anchor, a closed magnetic circle, whereby the anchor is connected with a switch spring, whose contacts work together with the constant contacts at the spring jack.

A relay mentioned, in the introduction, for example, has become known from the same patent applicant as DE-OS No. 30 21 184. The known relay is formed bistably and the anchor is formed as a movable tumbler switch. The switch opening, arranged at the tumbler switch, together with the tumbler switch itself forms a considerable mass. The center of mass of the entire arrangement is not located in the turning point, rather at a distance therefrom, whereby an increased mass movement of inertia ensues and the switch stop of the relay is optimable.

The present invention has the object of so further developing a relay such as that mentioned in the introduction, that the moved mass can be essentially reduced.

To the solution of such object, the invention is thereby characterized in that, the switch spring has a footpiece of synthetic material applied thereto by a spraying operation which is fastened resolvably, pushably, and turnably at an appropriate opening of the anchor.

An essential characteristic of the present invention is therefore the interchangeability of the switch spring in the anchor. The switch spring is hereby fastened in the anchor with a radial and axial turnability. The device of the present invention is therefore usable for monostable as well as bistable relay, the anchor being incorporated in a rotatable tumbler switch, which has, between identical anchor plates, a permanent magnet. With the resolvable fastening of the switch spring in the region of the anchor or the tumbler switch, is the essential advantage attained, that the pivot is laid near to the mass center and the stopping of the switch of the relay is thereby favorably influenced. The resolvable fastening of the switch spring in the region of the anchor or the tumbler switch can be loosened in various ways. Important is the fact that the switch spring itself is always interchangeable and that a radial and axial turnability is guaranteed. Thereby it is, for example, possible to build up a relay as with building blocks and to insert a switch spring of special construction in replacement of another switch spring.

Important is the feature that the switch spring has a sprayed-on synthetic footpiece of the kind referred to which is set in an opening of the tumbler switch and is radially and axially turnable.

A before mentioned construction of radial turnability consists according to the object of claim 4 that, at the rear end of the footpiece, lateral protruding projections are arranged; the footpiece in a first position pass through the opening of the anchor or tumbler switch; and in the 90°-turned position the footpiece with its projections grips behind appointed rear cuts in the region of the anchor or the tumbler switch.

A special shaping of an axial pushability is, according to the object of claim 5, that at the front side of the footpiece that grips into the opening, a first anchor plate is arranged, which is arranged pushably at the rear side of the plate of the tumbler switch; beneath the first anchor plate a permanent magnet is arranged, which for its part is so uncovered by a second anchor plate which, by means of notch noses arranged at the side surfaces of the tumbler switch, is pushably and resolvably fastened at the tumbler switch. For the dismantling of the switch spring, the anchor plate, fastened from the notch noses, must next be loosened from the tumbler switch, in order thus to separate the permanent magnet and then to separate the anchor plate lying at the front side of the footpiece. First, then can the footpiece of the switch spring be axially pushed a short bit inwards and turned in order to thus be taken out of the opening of the tumbler switch.

Further characteristics of the invention are the object of the remaining subclaims.

The object of the invention of the present invention arises not only from the objects of the individual patent claims, but rather from the combination of the individual claims together. All of the specifications and characteristics revealed in the documents, especially the spatial constructions presented in the drawings, are claimed as essential to the invention insofar as they, individually or combined, are new relative to the state of the technics.

In the following, the invention will be more closely illustrated, solely by means of a construction means presented in the drawings. Hereby are presented in the drawings and their description further specifications are characteristics essential to the invention.

Figure 2:
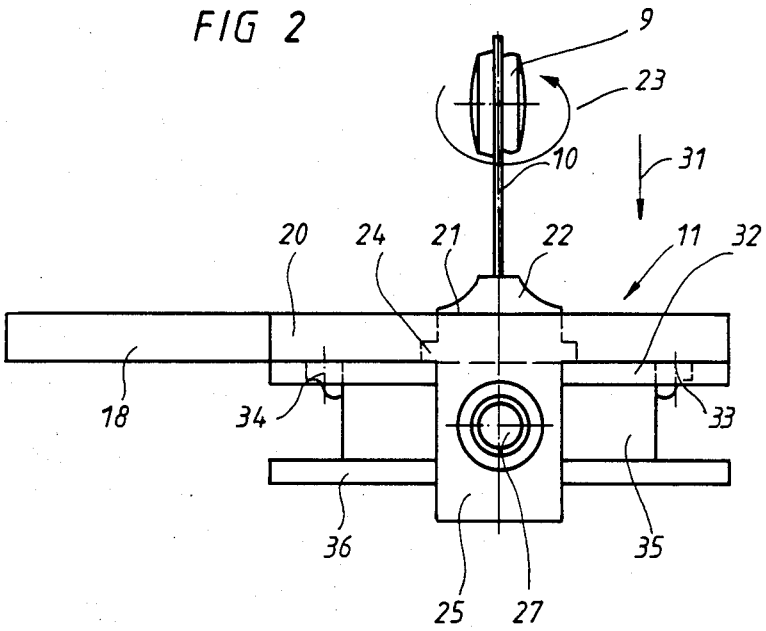
Figure 3:
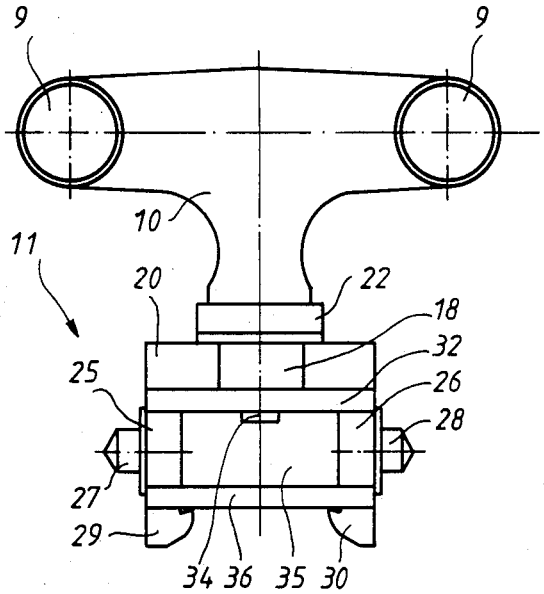
Figure 4:
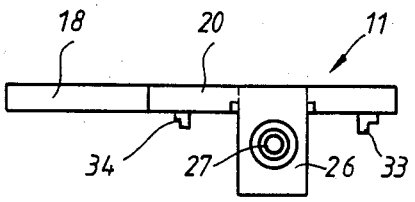
Figure 5:
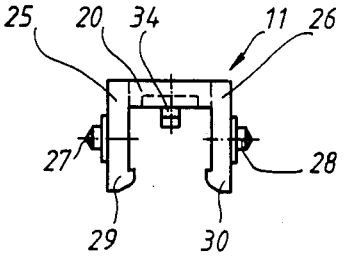
Figure 6:
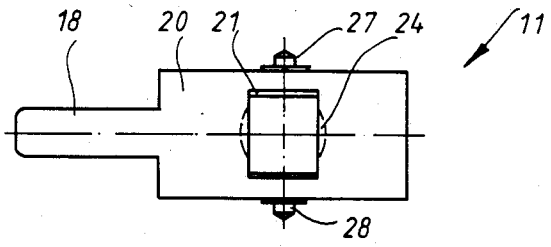
Figure 8:
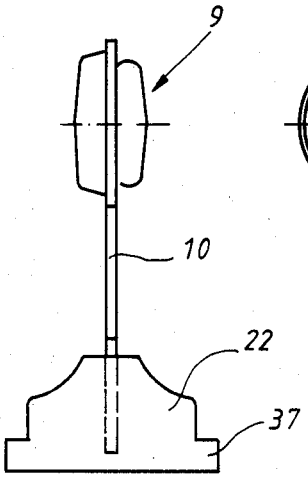
Figure 7:
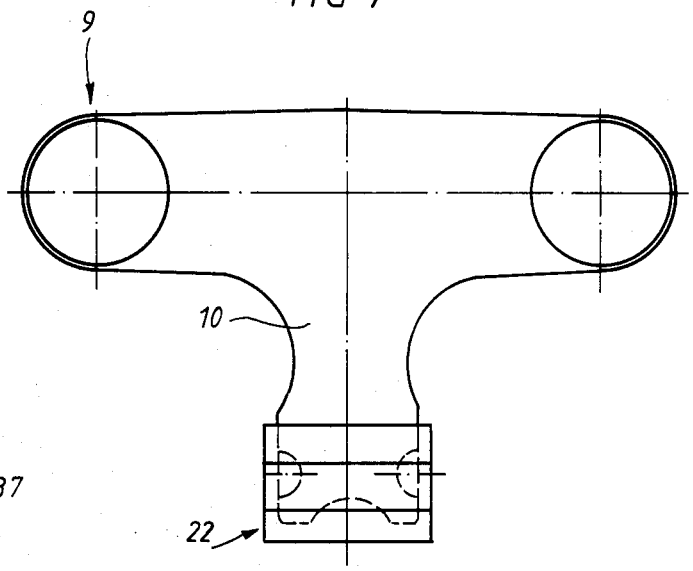

They show:

FIG. 1—Side view of a bistable relay,

FIG. 2—Side view of the anchor tumbler switch with inserted switch spring,

FIG. 3—A presentation turned 90° in comparison to FIG. 2,

FIG. 4—Side view of the anchor tumbler switch without switch spring,

FIG. 5—Front view of the anchor tumbler switch,

FIG. 6—Overview of the anchor tumbler switch,

FIG. 7—Side view of the switch spring,

FIG. 8—Front view of the spring switch.

The relay according the the invention consists of a removable cap 1, with a spring jack 2, which has a contact carrier 3 which has 3-piece bonding screws 4, and 3-piece hole clamps 5. The contact carrier 3 consists at its upper part of a bent metal bow that extends over to a stationary contact 6.

There is further a contact carrier 7, which likewise has a stationary contact 8. Further there is a switch spring 9 which is constructed as a bridge contact, that is, it always has contact with a stationary middle contact; the bridge spring is arranged at the free end of a punch part 10, and rests with its footpiece in a tumbler switch 11 which is rotatably fastened in a support plate 12 that is riveted to the metal part. The switch spring 9 has spaced contacts (FIGS. 3 and 7) which bridge corresponding contacts (FIG. 1), contacts 6 on one side and contacts 8 on the other side.

For the stabilization of the housing, an outer, synthetic circular bow 13 is provided. In the housing is further provided a relay coil 14 with connections 15 and 16. The relay coil 14 works on two yoke plates 17, 38. The tumbler switch 11 includes a grip 18 which extends through a corresponding hole 19 in the uncovering cap 1, so that it is hand operable.

The switch (FIG. 1) operates as an electromagnetic relay switch by means of the relay coil 14 and a magnet

(35) in the tumbler switch 11, referred to again hereinbelow. In the present switch, the tumbler switch is also actuatable by hand, as stated.

The tumbler switch consists, according to FIGS. 2 and 3, preferably of a synthetic material with a relatively long plate 20 in which an opening 21 is formed. In the opening 21 rests the switch spring 9 with footpiece 22 that is made of insulation material. An important feature is that the punch part 10 is completely surrounded by synthetic material, and the switch spring 9 is mounted in the opening 21 of the tumbler switch 11 by means of a turning motion. Such turning movement is made in the direction of the arrow 23 (FIG. 2), and the footpiece is put in the opening 21 in the manner of a bayonet coupling. The opening is provided with a rear cut, into which the footpiece 22 of the switch spring grips. The rear cut 24 is shown enlarged in FIG. 6 and shown more in detail.

The tumbler switch 11 consists further of two lateral support arms 25 and 26; at each support arm there are arranged at the outside, prominent support trunnions or bolts 27, 28. Further, there are arranged underneath each support arm, 25, 26, elongated notch noses 29, 30, whose function will be described later. For the axial securing of the footpiece 22, so that it doesn't fall out in the direction of the arrow 31 (FIG. 2), there is arranged behind the footpiece 22 in the region at the rear side of the support plate 20 of the tumbler switch 11, an anchor plate 32 in which borings are arranged, and which lies on correspondingly arranged fixing keys 33, 34 of the plate 20. Further, there is attached at the rear side of the support plate 20 a permanent magnet 35 which is held from the rear side by means of a double T-shaped anchor plate 36. The anchor plates 32, 36 are exactly alike.

The anchor plate 36 is held in notched position by the notch noses 29, 30 of the tumbler switch 11. Thereby are the magnet 35 and the first anchor plate 32 braced against the switch spring 9. The notch noses 29, 30 are, according to FIG. 3, notched with their notch noses on the corresponding support plate 36. Further, according to FIGS. 4–6, are the support bolts 27, 28 and the rear cut 24 identifiable in the region of the opening 21. In FIGS. 7 and 8 is the switch spring illustrated in still more detail. Important is that the footpiece 22 is provided with lower projections 37 which grip with a downward motion into the rear cuts 24, which are laid in circular shape in the region of the opening 21. By this means is the entire switch spring secured against a radial turning, and the axial pushability is effected by means of the support plate 32 therebehind, with the magnet 35 and further the support plate 36 which works together with the notch noses 29, 30.

Instead of fastening the switch spring in the manner of a bayonet coupling, it is of course possible to also effect other resolvable fastenings of the spring switch with its footpiece 22 in the region of the opening 21 by way of grooves with corresponding notch noses.

In the design with a bistable relay there is the additional advantage that the mounting of the anchor plate and the permanent magnet is very simple.

With a monostable relay there is no need for a tumbler switch with a permanent magnet and support plate, rather there is provided a simpler metal anchor, into which the switch spring is, in exactly the described manner, resolvably inserted.

As a variant this relay can also be constructed with a working contact; the then outside lying contact carriers are bridged over with the contact bridge. The contact instance is accordingly doubled, as opposed to the one-time switch-variants.

For convenience, the portion of the tumbler switch other than the switch spring 9 is also referred to herein as a base component.

I claim:

1. For incorporation in an electromagnetic relay having a pair of spaced apart stationary contacts, and having spaced side frame elements for mounting therebetween and therein a tumbler switch, a tumbler switch comprising, a base component including a magnet and a pair of anchor plates on opposite sides of and confining the magnet, said base component constituting a substantial mass and the greater part of the mass of the tumbler switch, the base component including a pair of oppositely arranged and co-axial trunnions for mounting the tumbler switch in said spaced side frame elements, said trunnions being positioned symmetrically of the directions of the base component transverse to the axis of the trunnions, and a switch spring mounted on the base component and extending therefrom, in direction radially of said axis.

2. A tumbler switch according to claim 1 wherein, the base component also includes an outer plate fitted to one of the anchor plates and including a handle for actuating the tumbler switch, the outer plate having a hole therein and the adjacent anchor plate being continuous in location in register with the hole, and the switch spring including a footpiece capable of being detachably fitted in said hole, and secured between the marginal edge of the hole and the adjacent anchor plate, for enabling replacement of the switch spring in the base component.

3. A tumbler switch according to claim 2, wherein, the switch spring includes an elongated element and the footpiece includes a molded piece at an end of the elongated piece, and the marginal edge of the hole and the footpiece are provided with interacting elements releasably locking the footpiece, and thereby the switch spring, in the hole.

4. A tumbler switch according to claim 3 wherein, the interlocking elements form a bayonet lock, in the use of which, the members to be locked are turned relative to each other.

5. A tumbler switch according to claim 2 wherein, the outer plate includes notch noses at the side edges thereof, extending in the direction of the thickness of the magnet and anchor plates, and releasably fit into notches in the anchor plates for securing the parts of the base components together.

* * * * *